US005826692A

United States Patent [19]

Blanc

[11] Patent Number: 5,826,692

[45] Date of Patent: Oct. 27, 1998

[54] DEVICE FOR TRANSFERRING PLATES BETWEEN A DRIVE CHAIN AND WORKSTATIONS

[75] Inventor: Roger Blanc, Le Pin, France

[73] Assignee: Etablissements Actis, Le Pin, France

[21] Appl. No.: 497,475

[22] Filed: Jun. 30, 1995

[30] Foreign Application Priority Data

Jul. 4, 1994 [FR] France ..... 94 08441

[51] Int. Cl.[6] ..... B65G 37/02; B65G 43/08

[52] U.S. Cl. ..... 198/346.1; 198/340; 198/346.2

[58] Field of Search ..... 198/340, 341, 198/346.2, 346.1

[56] References Cited

U.S. PATENT DOCUMENTS

| | | | |
|---|---|---|---|
| 3,527,087 | 9/1970 | Converse, III et al. | 198/346.1 X |
| 3,530,571 | 9/1970 | Perry | 198/346.1 X |
| 3,961,390 | 6/1976 | Giordano . | |
| 4,304,020 | 12/1981 | Bonnet et al. . | |
| 4,800,640 | 1/1989 | Miyazaki et al. . | |
| 4,995,502 | 2/1991 | Kitamura | 198/346.1 |
| 5,018,617 | 5/1991 | Miyata et al. | 198/346.1 |
| 5,099,981 | 3/1992 | Guzzoni | 198/346.2 X |
| 5,103,959 | 4/1992 | Carlson | 198/346.1 X |
| 5,178,255 | 1/1993 | Carlson | 198/346.1 |
| 5,271,139 | 12/1993 | Sticht . | |
| 5,370,212 | 12/1994 | Mizutani et al. | 198/346.1 |

FOREIGN PATENT DOCUMENTS

| | | | |
|---|---|---|---|
| 0 329 007 | 8/1989 | European Pat. Off. . | |
| 0 009 422 | 4/1980 | France . | |
| 3618755 | 12/1986 | Germany | 198/346.1 |
| 114351 | 7/1982 | Japan | 198/346.1 |
| 238612 | 10/1986 | Japan | 198/346.1 |
| 0158520 | 6/1990 | Japan | 198/346.1 |

*Primary Examiner*—Karen M. Young
*Assistant Examiner*—Thuy V. Tran
*Attorney, Agent, or Firm*—Oliff & Berridge, PLC

[57] ABSTRACT

Plates supporting articles in the course of manufacture are driven by adherence on an endless chain and are transferred to workstations situated to the side of the chain where the manufacturing operations are carried out. The transferral of the plates takes place along guide tracks perpendicular to the chain, by means of a transverse drive member actuated by a ram and interacting with a complementary part formed on each plate. The plates are thus brought into a position remote from the chain and close to a machine or to an operator. Means control the position of the plates at the intersection of the chain and of the guide tracks. The device applies to a line for the automatic or semi-automatic manufacture of shoes.

7 Claims, 4 Drawing Sheets

DEVICE FOR TRANSFERRING PLATES BETWEEN A DRIVE CHAIN AND WORKSTATIONS

The present invention relates to a device for transferring plates supporting articles or objects in the course of manufacture between a chain for driving these plates and workstations, on a line for the automatic or semi-automatic manufacture of articles or of objects, comprising in known fashion, at least one continuously traveling endless chain driving the plates through an adherence effect along a determined path bringing them in succession to a certain number of workstations situated to the side of the chain, where the various manufacturing or processing operations for the articles or objects supported by said plates are performed. This invention applies more particularly, although not exclusively, to an automated or semiautomated line for manufacturing shoes.

BACKGROUND OF THE INVENTION

In an installation of this sort, where a chain driving the plates causes them to pass one after another to a certain number of workstations, it is convenient to be able to halt the plates at the workstations, and to separate these plates from the chain in order to bring the articles in the course of manufacture to automatic machines (robots), or to present them to an operator carrying out a manual operation. In the case of a shoe manufacturing line, the problem is complicated by the fact that shoes of different sizes, for right feet or for left feet and belonging to various types which do not always require the same manufacturing operations, or where, at least, these operations need to be adapted, follow on from each other. It is therefore convenient not only to shift plates supporting shoes in the course of manufacture, but also to identify and to follow each of the shoes along the manufacturing line in order to make each shoe undergo the appropriate operations at the various workstations and, possibly, in order not to introduce this shoe to some workstations.

In this context, the present invention affords a simple and reliable solution for workstations situated on one or both sides of the chain for driving the plates.

SUMMARY OF THE INVENTION

The device proposed essentially comprises, for a workstation situated on one side of the drive chain, at least one guide track for the plates, extending perpendicularly to the direction of travel of the chain, and for each track a transverse drive member designed to interact with a complementary part formed on each plate, the transverse drive member being able to travel in terms of translation perpendicular to the chain, under the action of operating means, between a position close to the drive chain and a position remote from said chain but close to a machine or an operator performing an operation or a process on the articles or objects borne by the plates, means being provided for controlling the position of the plates especially at the intersection of the chain and of the or each guide track.

The device preferably comprises at least two parallel guide tracks for the plates, extending one beside the other perpendicularly to the drive chain.

Thus, at the workstation in question, the plates bearing the articles or objects in the course of manufacture can be extracted selectively from the drive chain, these plates then engaging on the transverse drive members, which shift them perpendicularly to the chain in order to bring them towards the machine or the operator, then to return them to the chain. In the case of two tracks, the operations of transferring a plate between the chain and the machine or the operator take place on one track while this machine or this operator is operating on an article or object borne by a plate on the other track, this affording "parallel operation".

According to one simple embodiment of the device, the or each guide track consists of a pair of guides, perpendicular to the chain and borne by a horizontal bed, the separation between the two guides of one same pair being substantially equal to the length of a plate. The plates thus rest and slide along the bed, between two guides, while they are shifted by the transverse drive member.

This transverse drive member associated with each guide track may be a bar which extends parallel to the drive chain and which has a profile, such as one in the shape of a dovetail, which complements the profile of at least one longitudinal groove formed in the lower face of each plate. When a plate arrives at a guide track, this groove in the plate engages directly over the transverse drive bar which is waiting in a suitable position.

According to a particular embodiment, the transverse drive bar is coupled, through a slot in the bed extending between the two guides parallel thereto, to a ram located underneath the bed.

The means provided for controlling the position of the plates at the intersection of the drive chain and of the or each guide track advantageously comprise presence detectors associated with retractable stops, at least one detector and at least one stop being associated with each track. These means, connected to a computerized system, make it possible to "manage" the movements of the plates, directing them selectively towards one or other of the two guide tracks, and preventing any collision or interference between the plates.

The device according to the invention can especially be used with plates to which are fitted removable supports for the articles or objects in the course of manufacture or of processing. In this case, the device also advantageously comprises, in register with the end-of-travel position of the plates which is remote from the drive chain and close to the machine or operator, indexing means designed to achieve temporary locking of a removable support borne by a plate brought into the said end-of-travel position by the transverse drive member.

Since the removable supports for the articles or objects in the course of manufacture or processing may be equipped with an electronic "chip" containing items of information relating to the articles or objects in the course of manufacture or of processing, there may furthermore be provided, in register with the end-of-travel position of the plates, which is remote from the drive chain and close to the machine or to the operator, means for reading the items of information contained in the electronic "chip" of a removable support borne by a plate brought into said end-of-travel position by the transverse drive member.

In particular, when the invention is applied to a line for the automatic or semi-automatic manufacture of shoes, the shoes in the course of manufacture are mounted on lasts held by removable supports themselves borne by the plates. Each electronic "chip" equipping a removable support, then contains data relating to the shoe in the course of manufacture.

DESCRIPTION OF THE DRAWINGS

The invention will be better understood with the aid of the description which follows with reference to the appended diagrammatic drawing representing, by way of example, one embodiment of this device for the transferral of plates between a drive chain and workstations, here applied to a shoe manufacturing line.

Figure 1:
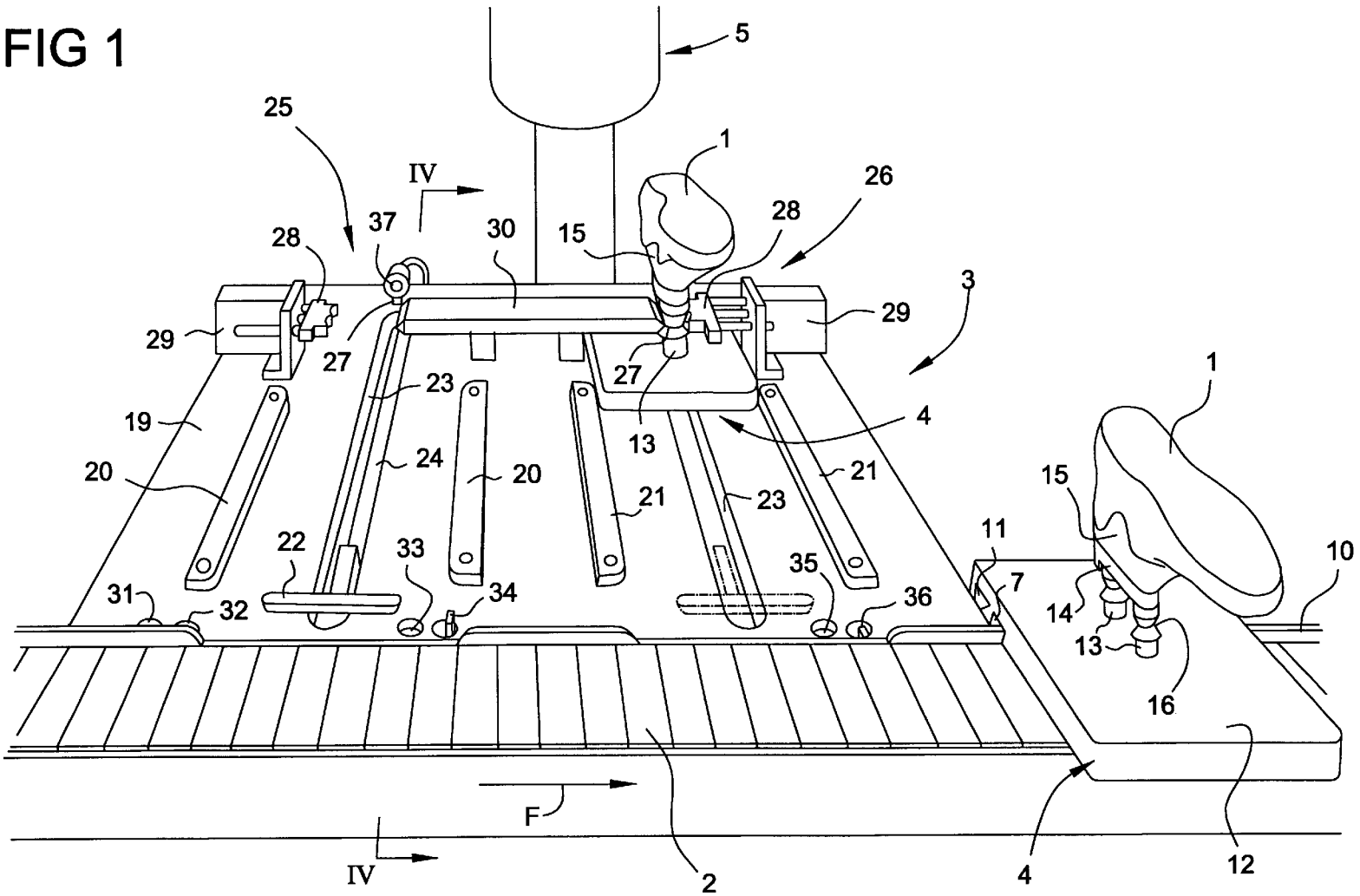
FIG. 1 is an overall view in perspective of a device in accordance with the present invention, placed to the side of a chain for driving plates.
Figure 2:
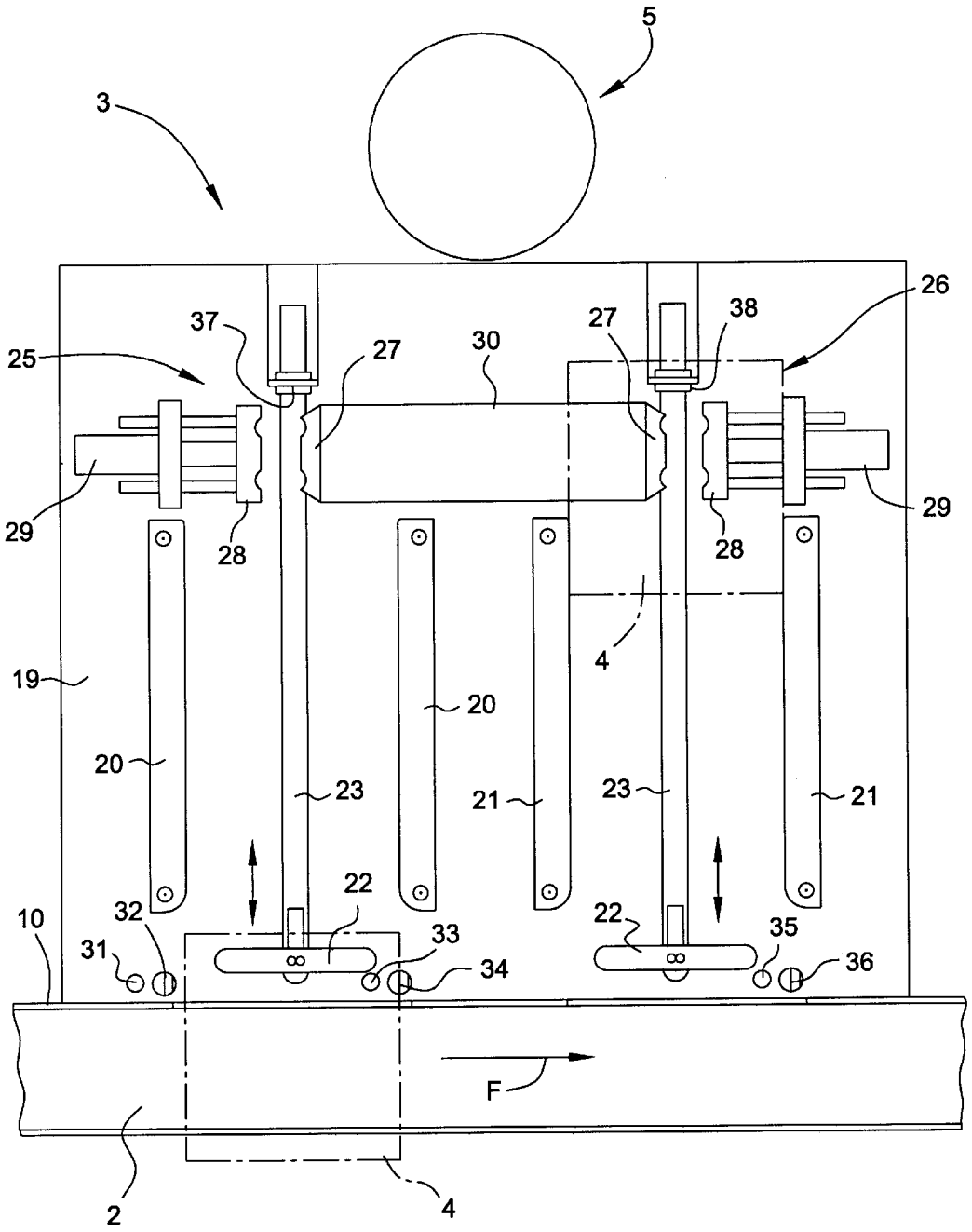
FIG. 2 is a plan view from above of the device of FIG. 1.

As FIGS. 1 and 2 show, the invention applies to a line for manufacturing shoes 1, comprising an endless push-plate chain 2 driven continuously in the direction of the arrow F, and fixed workstations 3, just one of which is represented here, and which are situated to one side of the chain, or to both sides thereof. The shoes 1 in the course of manufacture are supported individually by plates 4, which rest on the push-plate chain 2 and are driven forward by the latter through an adherence effect. At the workstation 3, the plates 4 are extracted from the chain 2 and transferred, with a movement perpendicular to the direction of travel F of the chain 2 towards a robot or operator 5 performing a particular manufacturing operation at this point. Once this operation has been performed, each plate 4 is returned to the chain 2, which can then drive it forward to the next workstation.

Figure 3:
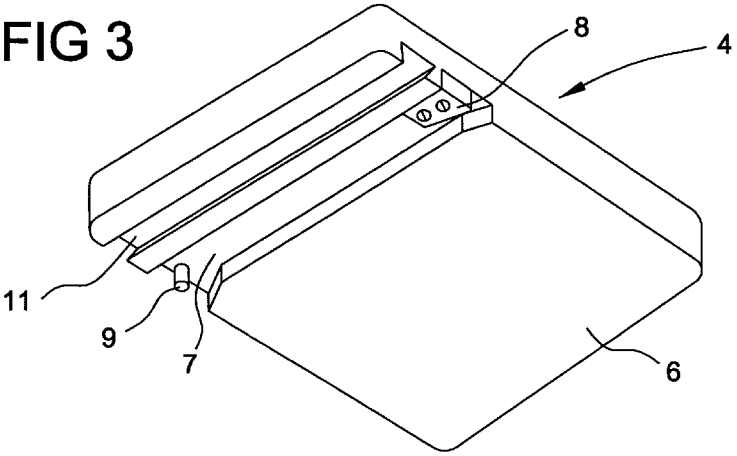
FIG. 3 is a view in perspective of just a plate, viewed from underneath.

Referring also to FIG. 3, each plate 4, of rectangular overall shape, on its lower face 6 has a first longitudinal groove 7 of rectangular cross section serving to guide it. At the two ends of the groove 7 there are fastened, respectively, a pad 8 and a finger 9. The longitudinal groove 7 is designed to interact with a fixed guide rail 10, which runs alongside the drive chain 2 on one of its edges (the term "longitudinal" here referring to the direction of travel F of the chain 2).

The lower face 6 of the plate 4 has another longitudinal groove 11, parallel to the first one and of dovetail cross section, which comes into use at the workstation 3 as explained hereafter.

Projecting from the upper face 12 of the plate 4 are two vertical posts 13 each ending in a spike. Fitted onto the two posts 13 is a removable support 14 for a last 15 on which a shoe 1 is manufactured. The removable support 14, in its lower part, has two "diabolo" shapings 16, which respectively surround the two posts 13.

The removable support 14 is provided with a lateral downwardly pointing tab 17 on which there is mounted an electronic "chip" 18 capable of storing in memory items of information relating to the shoe 1 in the course of manufacture, these items of information not being limited merely to the predetermined characteristics of the shoe 1, it also being possible for them to be evolutionary and to include the list of the operations already performed, or remaining to be performed, for a shoe 1 in the course of manufacture.

Provided at the workstation 3 is a horizontal bed 19 adjacent to the chain 2. The bed 19 bears a first pair of guides 20 perpendicular to the chain 2, and a second pair of guides 21, themselves also perpendicular to the chain 2 and situated further downstream than the first pair of guides 20 (by reference to the direction of travel F of the chain 2). The guide rail 10 is interrupted opposite the first pair of guides 20 and opposite the second pair of guides 21. The gap between the two guides 20 or 21 of each pair is equal to the length of a plate 4 (the "length" here being the dimension measured in the direction of travel F of the chain 2).

Figure 4:
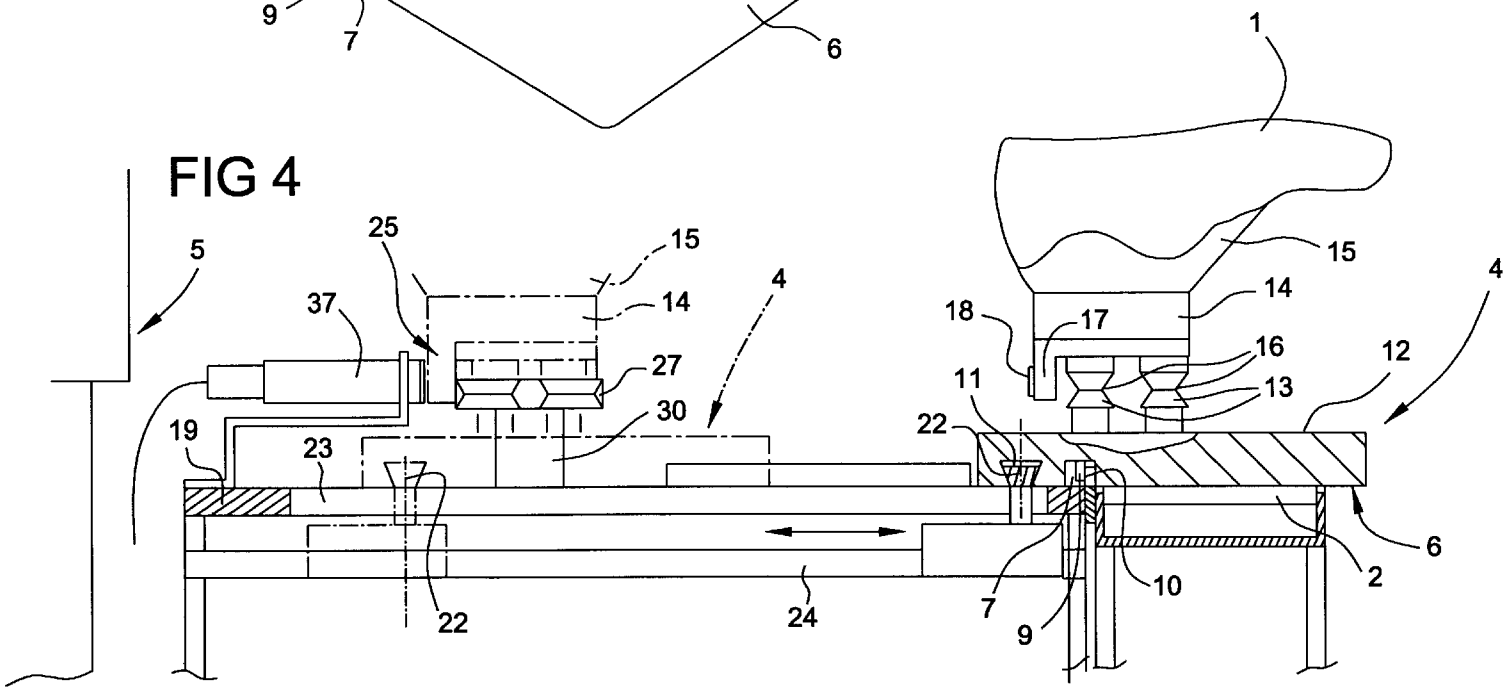
FIG. 4 is a sectional view of the device on IV—IV of FIG. 1.

Mounted between the two guides 20 or 21 of each pair, and able to move in translation parallel to these guides, is a bar 22 for transverse driving of the plates, which extends parallel to the chain 2 and which has a dovetail profile corresponding to that of the groove 11 formed under each plate 4—see also FIG. 4. Each bar 22 is coupled, through a slot 23 in the bed 19 extending between the two guides 20 or 21 parallel thereto, to a ram 24 located under the bed 19. This is, especially, a ram 24 with magnetic coupling, of a known type. Each bar 22 can thus be shifted, between a forward position close to the chain 2 and a withdrawn position close to the robot or to the operator 5.

On the bed 19, in the region remote from the chain 2 and close to the robot or to the operator 5, are provided two indexing devices 25 and 26 associated respectively with the two pairs of guides 20 and 21. Each indexing device 25 or 26 includes a fixed jaw 27 situated facing a moving jaw 28 which can travel parallel to the chain 2 (and therefore perpendicularly to the guides 20 and 21) by means of a ram 29. In the example represented, the two fixed jaws 27 are located internally and borne by one and the same support 30, while the moving jaws 28 are located externally, the associated rams 29 being close to the edges of the bed 19.

On its edge adjacent to the chain 2, the bed 19 includes, from upstream to downstream (with reference to the direction of travel F of the chain 2):

a first detector 31, immediately followed by a first retractable stop 32, which are situated substantially at the first guide 20;

a second detector 33, immediately followed by a second retractable stop 34, which are situated substantially at the second guide 20;

a third detector 35, immediately followed by a third retractable stop 36, which are situated substantially at the second guide 21.

Finally, towards its edge which is the most remote from the chain 2, the bed 19 bears a first reader 37 situated in the plane of symmetry of the first pair of guides 20, and a second reader 38 situated in the plane of symmetry of the second pair of guides 21.

The overall operation of the device is as follows:

Plates 4 bearing lasts 15 taking the shoes 1 in the course of manufacture are shifted along the chain 2 and, in succession, arrive at the workstation 3 in question. The arrival of a plate 4 is recognized by the first detector 31, and this plate 4 is halted or released by the first retractable stop 32.

Once released, the plate 4 is driven further along by the chain 2, and it may be halted either by the second stop 34 which immobilizes it facing the first pair of guides 20, or by the third stop 36 which immobilizes it facing the second pair of guides 21.

Assuming that the plate 4 has been halted by the second stop 34, this plate 4 engages, via its lower dovetail groove 11 over the bar 22 of corresponding profile which is then placed towards the end of the guides 20 closest to the chain 2.

Next, the ram 24 associated with the bar 22 is actuated in order to shift it in the direction of moving it away from the chain 2. The bar 22 then drives the plate 4 along with it, which plate is taken away from the chain 2 and travels perpendicularly thereto, being guided between the two guides 20 so as to be brought into a region of the bed 19 which is remote from the chain 2 and close to the robot or to the operator 5.

When the plate 4 has reached its position furthest from the chain 2, the corresponding ram 29 is actuated in order to bring the moving jaw 28 close to the fixed jaw 27 situated facing it. The two shapings 16 belonging to the support 14 for the last 15 placed on the plate 4 are thus clamped between the fixed jaw 27 and the moving jaw 28. The support 14 is then raised slightly and immobilized appropriately in a precise position and the robot or the operator 5 can perform on the shoe 1 the intended operation at the workstation 3 in question, for example pasting or roughing or any other manufacturing step.

When the plate 4 arrives in its end-of-travel position remote from the chain 2, the electronic "chip" 18 comes close to the first reader 37, which reads the items of information contained in this "chip" and operates the robot 5 as a consequence of this so that the operation performed corresponds to the characteristics of the shoe 1 to be manufactured. There may additionally follow automatic recording, on the "chip" 18, of the operation which has been performed.

Once this operation has been accomplished, the moving jaw 28 is released, thus freeing the support 14 and the last 15. The ram 24 is actuated in the opposite direction from the previous movement, in order to return the bar 22 and therefore the plate 4 towards the chain 2. When the plate 4 has returned to the axis of the chain 2, the second stop 34 retracts and allows the plate 4 to be driven on further, especially towards another workstation, by the chain 2. The bar 22 can then be returned backwards "empty", or transfer another plate 4.

In the case of a plate 4 halted by the third stop 35 opposite the second pair of guides 21, the process is the same as the one described previously, the plate 4 then being released from the chain 2 and brought close to the robot or to the operator 5, being guided between the other two guides 21, by virtue of the intervention of the other bar 22. In the end-of-travel position of the plate 4 (position visible in FIG. 1), the second reader 38 comes into action.

It will be noted that operation takes place in parallel, it being possible for one plate 4 to be transferred from the chain 2 towards the robot or to the operator 5, or vice versa, on one of the two "tracks" (defined for example by the first pair of guides 20), while the robot or the operator 5 is performing an operation on a shoe 1 borne by a plate 4 halted at the end of travel on the other "track" (defined for example by the second pair of guides 21).

In such operation, the detectors 31, 33 and 35 and the retractable stops 32, 34 and 36 which are associated with an appropriately programmed computerized system, prevent any collisions or interferences between plates 4; for example, if the detector 33 or 35 indicates the presence of a plate 4 on the chain 2 facing one of the two "tracks", the system delays the return of a plate 4 from this "track" to the chain 2, by preventing the operation of the corresponding ram 24. Furthermore, the first detector 31 associated with the first retractable stop 32 makes it possible to place plates 4 in a standby position, accumulating them if necessary, before admitting them to the device by lowering the stop 32. The computerized system can also determine towards which track, identified as being free, each plate 4 is directed, so as to optimize the operation of the whole. If all the stops 32, 34 and 36 are retracted at the passage of a plate 4, the latter can be driven forward on the chain 2 without being transferred to the workstation 3 in question, this allowing the plate 4 to "skip" this station to go directly to the next one, so that the manufacturing line equipped with the device according to the invention has great flexibility.

Figure 5:
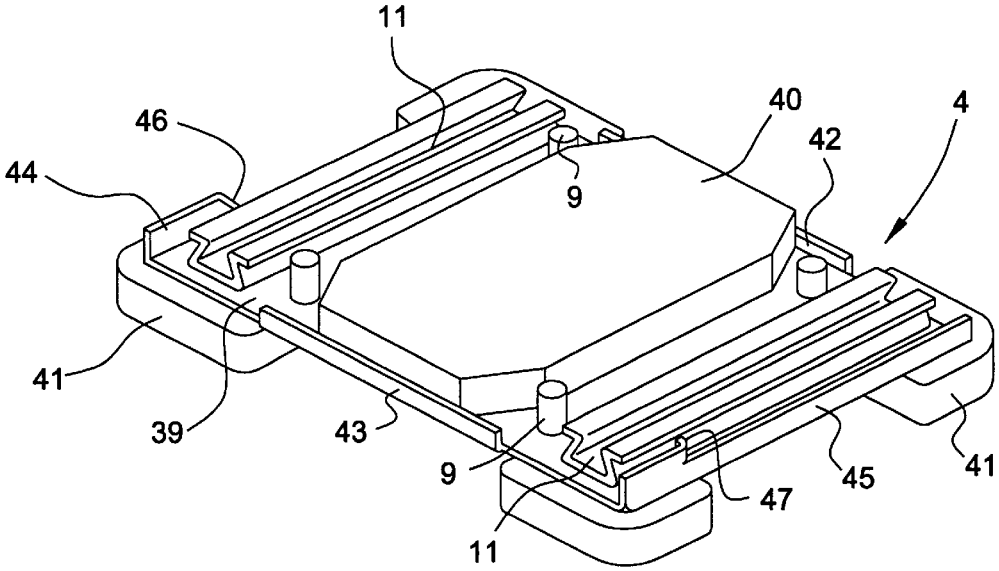
FIG. 5 is a more detailed view in perspective of a plate, viewed from underneath, in an improved embodiment.
Figure 6:
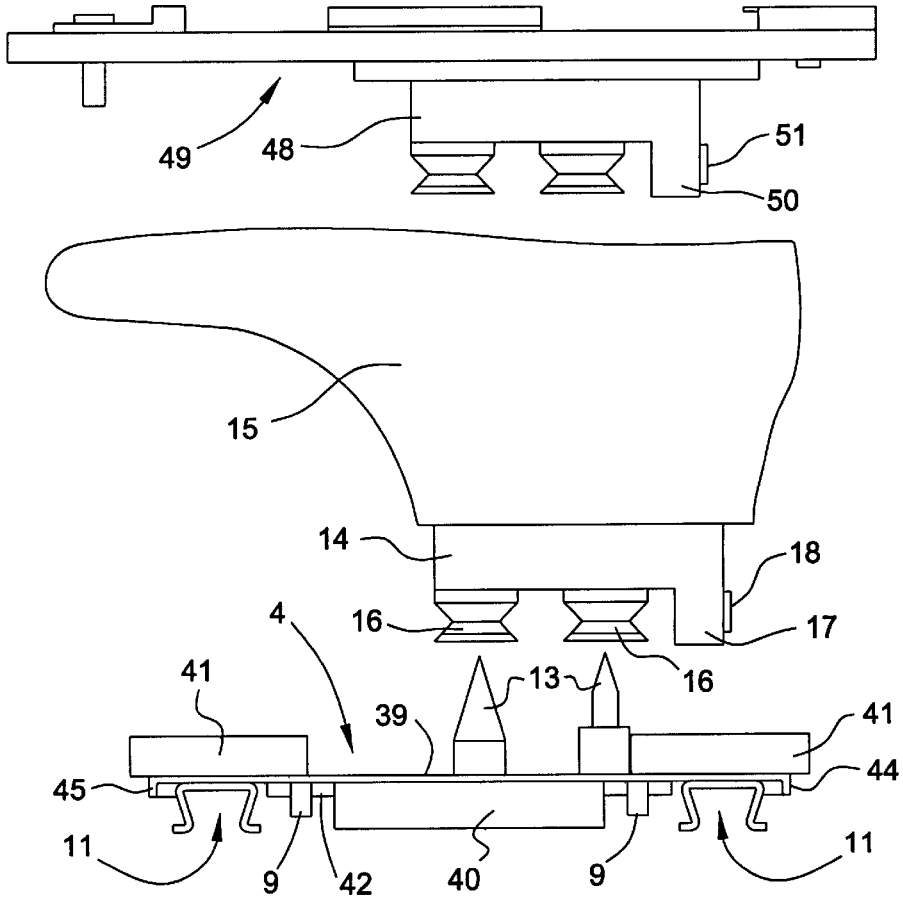
FIG. 6 is a side view of the plate of FIG. 5, with an indication of two types of removable support which can be fitted to this plate.

While FIGS. 1 to 4 show the basic principle of the plate 4, FIGS. 5 and 6 represent a particular embodiment of this plate 4 in more detail, and more fully illustrate its use capabilities.

The plate 4 has a rectangular metal push plate 39, under which a central friction panel 40 made of synthetic material and coming into contact with the drive chain 2 is fixed. Fitted to the four corners of the push plate 39 are friction pads 41 made of a synthetic substance, with a rounded external profile; the pads 41 allow two consecutive plates 4 to describe a suitable relative movement in the curved parts of the path of the chain 2.

Provided symmetrically under the push plate 39 on either side of the central friction panel 40 are two parallel grooves 11 of dovetail cross section. By virtue of these two grooves 11, the plate 4 can be transferred to workstations situated without preference to the right or to the left of the drive chain 2.

Two pairs of fingers 9 are provided under the push plate 39, respectively on either side of the central friction panel 40. The fixed guide rail 10 can thus pass on one side or the other of the friction panel 40, between it and the two adjacent fingers 9. These fingers 9 also interact with the presence detectors.

The push plate 39 has a front edge folded downward 42, the ends of which interact with the retractable stops (such as 32, 34, 36) which halt or release the plate 4. The push plate 39 further includes a rear edge folded downward 43, which is shorter than the folded front edge 42, so as not to run into the retractable stops. Thus, a retractable stop can be lowered to release a plate 4, then raised very quickly in order to be sure of halting the next plate.

Finally, the right-hand and left-hand side edges 44 and 45 of the push plate 39 are themselves also folded downward and they have tabs bent inward, respectively 46 and 47, which interact with other stops involved in the rotational movements of the plates 4, in the case where the circuit for the plates has forks.

As FIG. 6 shows, the two posts 13 projecting from the upper face 12 of the plate 4 give the possibility, as desired, of fitting a removable support 14 taking a last 15, as already described previously, or fitting a removable support 48 integral with a sole-holder plate 49. As with the support 14, the support 48 taking the sole-holder plate 49 is provided with a lateral tab 50 on which an electronic "chip" 51 is mounted.

It would not be departing from the scope of the invention to:

modify the number of "tracks" of the device, which extend perpendicular to the drive chain;

modify the constructional details, for example replacing the dovetail profile (of the groove 11 and of the bar 22) by a T-shaped profile, have recourse to any means equivalent to those described, it thus being possible for the rams for moving the bars to be replaced by any operating means, and it being possible for the folded-down edge 42 to be replaced by any part projecting downward, at the front of the plate 4, and able to interact with the retractable stops, target the device for a line for manufacturing articles or objects other than shoes, it being possible for the workstations in question to carry out any operations or processes.

I claim:

1. A device for transferring plates supporting articles or objects in the course of manufacture or processing, between an endless drive chain on which these plates rest and are driven by an adherence effect, and workstations where operations or processes are carried out on these articles or objects, which comprises, for a workstation situated on one side of the drive chain, at least one guide track for the plates, extending perpendicularly to the direction of travel of the chain, and for each track a transverse drive member which interacts with a complementary part formed on each plate, the transverse drive member being able to travel in terms of translation, under the action of operating means, between a position close to the drive chain and a position remote from said chain but close to a machine or an operator performing an operation or a process on the articles or objects borne by the plates, said plates traveling from said drive chain to said guide track in a single horizontal plane, means being provided for controlling the position of the plates especially at the intersection of the chain and of the or each guide track;

wherein the or each guide track consists of a pair of guides, perpendicular to the chain and borne by a horizontal bed, the separation between the two guides of one same pair being substantially equal to the length of a plate; and wherein the transverse drive member is coupled, through a slot in the bed extending between the two guides parallel thereto, to a ram located underneath the bed.

2. A device for transferring plates supporting articles or objects in the course of manufacture or processing, between an endless drive chain on which these plates rest and are driven by an adherence effect, and workstations where operations or processes are carried out on these articles or objects, which comprises, for a workstation situated on one side of the drive chain, at least one guide track for the plates, extending perpendicularly to the direction of travel of the chain, and for each track a transverse drive member which interacts with a complementary part formed on each plate, the transverse drive member being able to travel in terms of translation, under the action of operating means, between a position close to the drive chain and a position remote from said chain but close to a machine or an operator performing an operation or a process on the articles or objects borne by the plates, said plates traveling from said drive chain to said guide track in a single horizontal plane, means being provided for controlling the position of the plates especially at the intersection of the chain and of the or each guide track;

wherein the transverse drive member associated with each guide track is a bar which extends parallel to the drive chain and which has a profile which complements the profile of at least one longitudinal groove formed in the lower face of each plate.

3. The device for transferring plates between a drive chain and workstations as claimed in claim 4, wherein each plate includes two parallel grooves provided on either side of a central friction panel interacting with the drive chain.

4. The device for transferring plates between a drive chain and workstations, as claimed in claim 2, wherein said profile is in the shape of a dovetail.

5. The device for transferring plates between a drive chain and workstations, as claimed in claim 3, wherein said two parallel grooves in each plate are dovetail grooves.

6. A device for transferring plates supporting articles or objects in the course of manufacture or processing, between an endless drive chain on which these plates rest and are driven by an adherence effect, and workstations where operations or processes are carried out on these articles or objects, which comprises, for a workstation situated on one side of the drive chain, at least one guide track for the plates, extending perpendicularly to the direction of travel of the chain, and for each track a transverse drive member which interacts with a complementary part formed on each plate, the transverse drive member being able to travel in terms of translation, under the action of operating means, between a position close to the drive chain and a position remote from said chain but close to a machine or an operator performing an operation or a process on the articles or objects borne by the plates, said plates traveling from said drive chain to said guide track in a single horizontal plane, means being provided for controlling the position of the plates especially at the intersection of the chain and of the or each guide track;

said device being for plates to which are fitted removable supports for the articles or objects in the course of manufacture or of processing, wherein there are provided, in register with an end-of-travel position of these plates which is remote from the drive chain and close to the machine or operator, indexing means to achieve temporary locking of a removable support borne by a plate brought into the end-of-travel position by the transverse drive member.

7. A device for transferring plates supporting articles or objects in the course of manufacture or processing, between an endless drive chain on which these plates rest and are driven by an adherence effect, and workstations where operations or processes are carried out on these articles or objects, which comprises, for a workstation situated on one side of the drive chain, at least one guide track for the plates, extending perpendicularly to the direction of travel of the chain, and for each track a transverse drive member which interacts with a complementary part formed on each plate, the transverse drive member being able to travel in terms of translation, under the action of operating means, between a position close to the drive chain and a position remote from said chain but close to a machine or an operator performing an operation or a process on the articles or objects borne by the plates, said plates traveling from said drive chain to said guide track in a single horizontal plane, means being provided for controlling the position of the plates especially at the intersection of the chain and of the or each guide track;

said device being for plates which take removable supports for the articles or objects in the course of manufacture or processing, the supports being equipped with an electronic chip containing items of information relating to the articles or objects in the course of manufacture or processing, wherein there are moreover provided, in register with the end-of-travel position of the plates which is remote from the drive chain and close to the machine or to the operator, means for reading the items of information contained in the electronic chip of a removable support borne by a plate brought into said end-of-travel position by the transverse drive member.

* * * * *